US005576508A

United States Patent [19]

Korpi

[11] Patent Number: 5,576,508

[45] Date of Patent: Nov. 19, 1996

[54] EXTENDABLE ARMOR

[75] Inventor: John G. Korpi, Wayne County, Mich.

[73] Assignee: The United States of America as represented by the Secretary of the Army, Washington, D.C.

[21] Appl. No.: 536,308

[22] Filed: Sep. 26, 1995

[51] Int. Cl.[6] ..... F41H 5/00

[52] U.S. Cl. ..... 89/36.01; 89/36.04; 89/36.08; 89/36.09

[58] Field of Search ..... 89/36.01, 36.04, 89/36.08, 36.09

[56] References Cited

U.S. PATENT DOCUMENTS

| | | | |
|---|---|---|---|
| 3,478,643 | 11/1969 | Forsyth et al. | 89/36.09 |
| 3,559,527 | 2/1971 | Schallehn | 89/36.08 |
| 4,833,968 | 5/1989 | Bohne et al. | 89/36.08 |

*Primary Examiner*—J. Woodrow Eldred
*Attorney, Agent, or Firm*—Peter A. Taucher; David L. Kuhn

[57] ABSTRACT

A vehicle's armor assembly has a track on the vehicle's exterior, a pair of carriers translatable along the track, and a rotatable threaded rod for effecting relative axial motion of the carriers along the track. Arms of unequal length pivot on the carriers, the longer arm having a more elongate slot than does the shorter arm. A pin closely fits the slots and connects the arms at their intersection so that the arms are translatable and rotatable relative to the pin. The armor assembly has an armor plate or like element to which is fixed a pair of hinge elements, and the hinge elements have rotational connections to the arms. The carriers, arms and hinges act in concert to move the armor element from a retracted position to a deployed position. The retracted position is near the exterior zone and is parallel thereto, whereas the deployed position is remote from the exterior zone and oblique thereto.

7 Claims, 3 Drawing Sheets

EXTENDABLE ARMOR

GOVERNMENT USE

The invention described here may be made, used and licensed by or for the U.S. Government for governmental purposes without paying me royalty.

BACKGROUND

Combat vehicles are threatened by increasingly lethal gun and ammunition technology. One of the most lethal current threats is the shaped charge anti-tank round, which burns its way through armor via a plasma jet formation. The most effective structures to defeat shaped charge rounds use air spaces between layers of armor, highly increased armor thickness or a combination of air spaces and thicker armor. Generally, these structures add cost, weight and width to vehicles. Greater vehicle width is particularly undesirable from a military standpoint, since increased width lessens the vehicle's transportability and lessens its ability to maneuver in confined areas.

SUMMARY

My vehicle armor assembly is a modular unit that deploys an armor plate or other armor element at a distance from the vehicle but retracts the plate when the vehicle is transported or when the vehicle is in close quarters. Of course, any number of the assemblies can be fit to the hull or turret of an armored combat vehicle. Because of its ability to deploy and retract an armor plate, the armor assembly meets the need for protection against shaped charge rounds while avoiding a permanent increase in vehicle size. This armor assembly is cheaper and lighter than known armor structures offering comparable protection from shaped charge rounds.

My armor assembly has a track on the vehicle exterior, and two carriers translate along the track. Rotation of a rod threaded with the carriers translates the carriers toward or away from one another along the track. My assembly has two arms. One is a relatively shorter arm that pivots on one of the carriers, and the other is a relatively longer arm that pivots on the other carrier. Each arm defines a slot, the longer arm having a more elongate slot than the shorter arm's slot. Connecting the arms at their intersection is a pin diametrically sized to closely fit through the slots. The arms translate and rotate relative to the pin as the arms swing out from the vehicle or swing back toward the vehicle. My assembly has an armor element, such as a plate, which has two hinge elements pivoted to the arms. The carriers, arms and hinges cooperate to deploy or retract the armor element.

DETAILED DESCRIPTION

Figure 1:
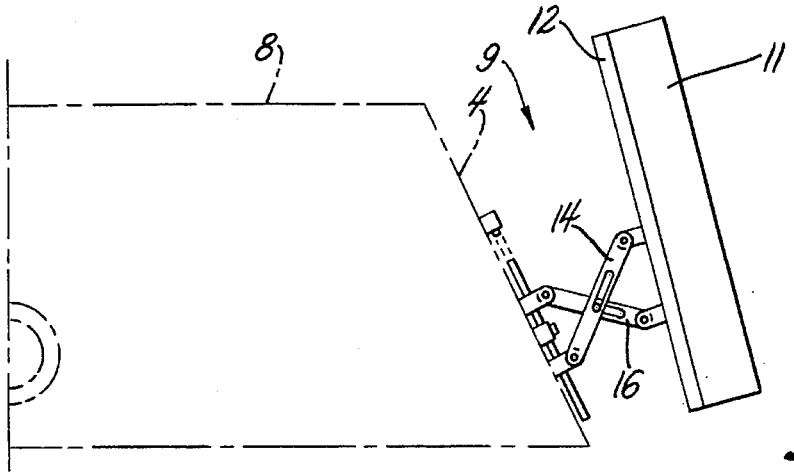
FIG. 1 is an elevational view of a first embodiment of the vehicle armor assembly as deployed on the turret of a tank.

FIG. 1 shows extendable armor unit 9 whose armor package comprises a relatively flat armor element 11 and armor plate 12. The armor package is held away from turret 8 by scissor arms 14 and 16. A multiplicity of such units can be attached to exterior zones of a tank turret, tank hull or like structure to form an expandable barrier or shell. Armor element 11 can be a reactive armor unit, a combination of ceramic and steel layers, a simple armor sheet or any known armor structure. The armor package is slanted relative to outer turret surface 4, whereby projectiles travelling normal to surface 4 toward turret 8 will be tumbled or partly redirected. In addition, space 2 between plate 12 and surface 4 helps defeat shaped charge rounds striking the armor package as they approach the turret. Space 2 typically has an inboard-to-outboard width of 6 inches to one foot, but this distance can vary for different armor protection schemes.

Figure 2:
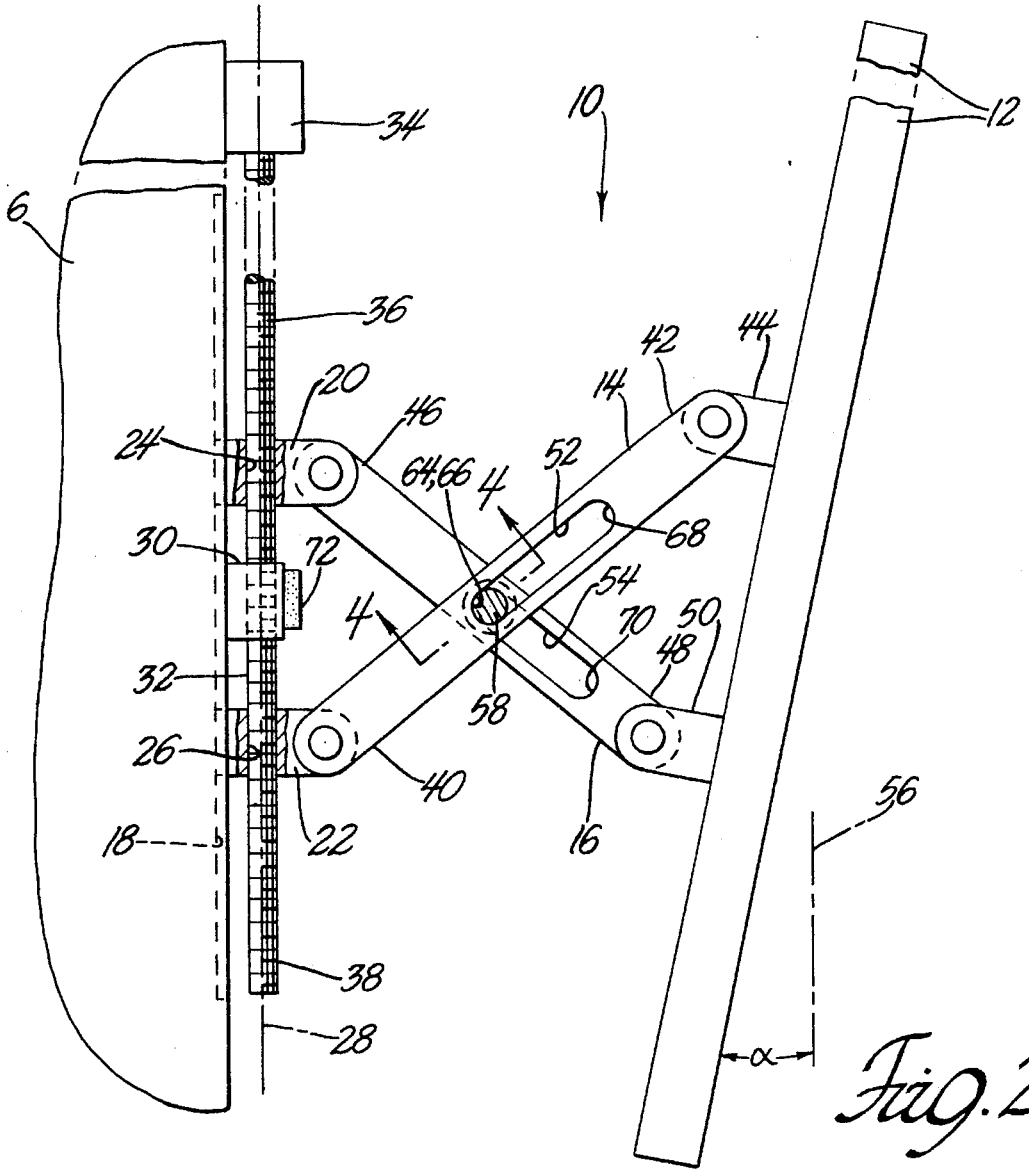
FIG. 2 is an enlarged elevational view of a slightly modified version of the vehicle armor assembly in a deployed configuration.

FIG. 2 shows an extendable armor unit 10 similar to unit 9, unit 10 being mounted on an exterior wall 6 of a tank hull (not shown). Wall 6 defines an elongate vertical track 18 which is preferably an elongate recess as seen in FIG. 2 but which can be a vertical rail adjacent wall 6. Closely and slidably seated with track 18 are translatable hinge elements or carriers 20 and 22 having respective threaded apertures 24 and 26 centered on axis 28. Fixedly mounted to wall 6 is bracket 30 through which passes rod 32, this rod being concentric with axis 28. Also mounted to wall 6 is a motor 34 or other means to turn rod 32, such as a manually operated crank. Rod 32 has a closely fitting, unthreaded engagement with bracket 30 and has oppositely threaded engagements with carriers 20 and 22. When rod 30 rotates, the carriers undergo relative axial motion along track 18; that is, the rod causes the carriers to move together or apart along track 18 on axis 28. Specifically, when rod 30 rotates in a first direction, carriers 20 and 22 move apart from each other and when rod 32 rotates in a second, opposite direction, carriers 20 and 22 move toward one another. Also, the rod's threaded segment 36 engaging carrier 20 has a different thread pitch than threaded segment 38 engaging carrier 22, segment 38 having more threads per inch than segment 36.

In a typical case, 50 rotations of rod 32 will deploy plate 12 from its retracted (FIG. 3) position to its deployed (FIG. 2) position. Carrier 20 and segment 36 will have 9.43 right-hand threads per inch while carrier segment 22 and segment 38 will have 8.22 left-hand threads per inch.

Inboard end 40 of arm 14 is pivoted to carrier 22 and outboard end 42 of arm 14 is pivoted to plate hinge element 44 fixed to plate 12. In like fashion, inboard end 46 of arm 16 is pivoted to carrier 20 and outboard end 48 of arm 16 is pivoted to plate hinge element 50 fixed to plate 12. Arm 14 is longer than arm 16, and elongate oval slot 52 in arm 14 is longer than the corresponding elongate oval slot 54 in arm 16. The inequality of length between arms 14 and 16 is chosen so as to create a desired angle $\alpha$ between plate 12 and a vertical reference line 56 when assembly 10 is deployed. Alternatively, reference line 56 need not be vertical but can be parallel to exterior wall 6, whereby $\alpha$ is the angle between wall 6 and plate 12.

Arm 14 and arm 16 are connected together at their intersection by pin 58 and the pin is held on arms 14 and 16 by a suitable member such as a collar 62 (FIG. 4) interferingly fit with the pin. The pin's diameter is equal to the width of slots 52 and 54 so the slots slide axially (relative to their own longitudinal axes) on the pin and turn about pin axis 60 (FIG. 4) without being loose on the pin. Simultaneous translation and turning of the arms relative to pin 58 occurs as assembly 10 deploys from its FIG. 3 position to its FIG. 2 position or vice versa. Typically, as shown in FIG. 2, inboard ends 64 and 66 of respective slots 52 and 54 are adjacent pin 58 when assembly 10 is in the deployed configuration. Likewise, as shown in FIG. 3, the respective outboard ends 68 and 70 of slots 52 and 54 are typically adjacent pin 56 when assembly 10 is retracted.

Figure 3:
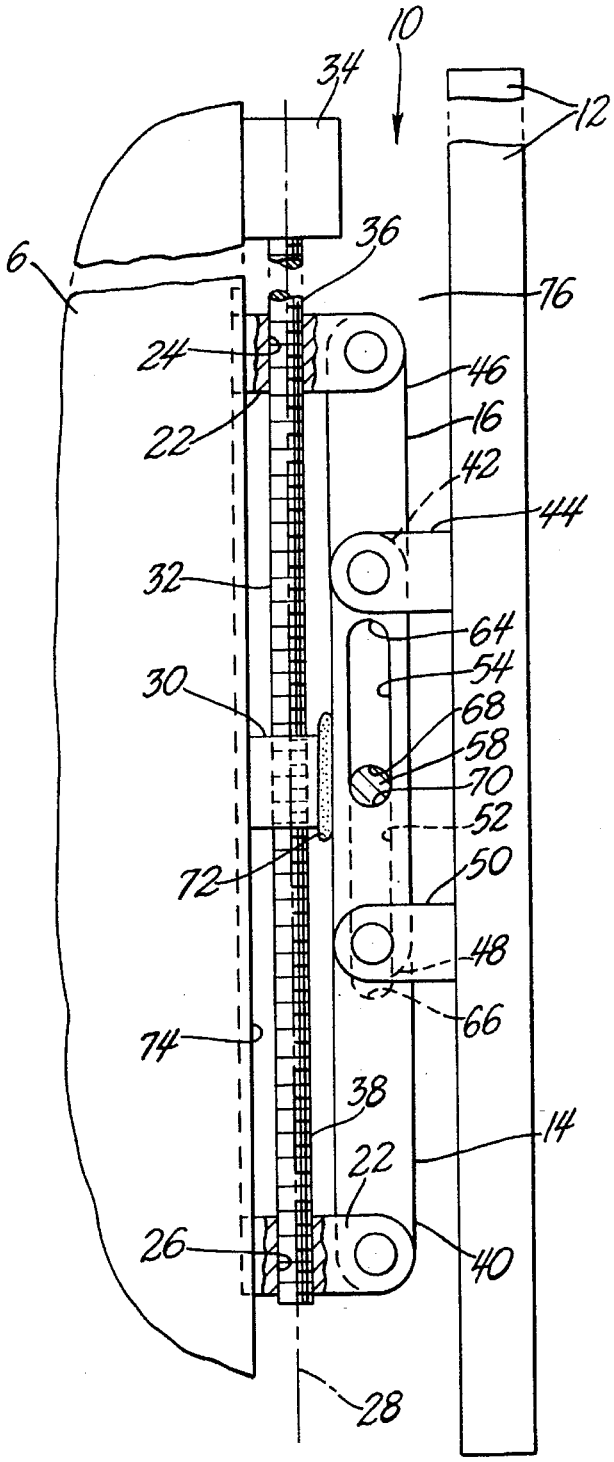
FIG. 3 is the vehicle armor assembly of FIG. 2 in a retracted configuration.
Figure 4:
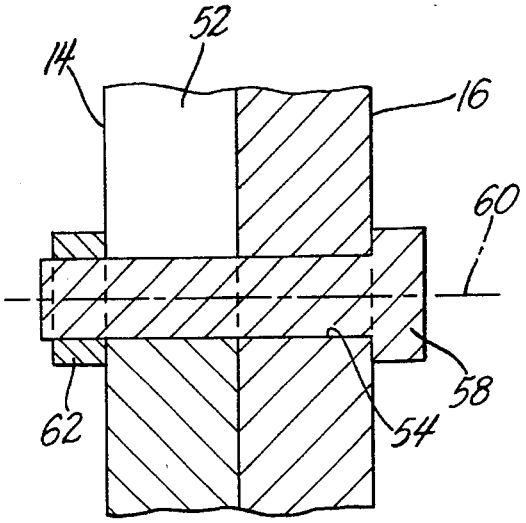
FIG. 4 is a view taken along line 4—4 in FIG. 2.

In FIG. 3, arms 14 and 16 align with each other and lie parallel to outer face 74 of wall 6 to minimize the flat, generally planar gap 76 between wall 6 and plate 12. Carriers 20 and 22 have moved apart, whereby plate hinge elements 44 and 50 clear the carriers as these hinge elements move to their FIG. 3 position. After arrival at their FIG. 3 positions, the plate hinge elements lie between carriers 20 and 22.

An optional feature is elastomeric button 72 shown in a compressed state in FIG. 3 and shown in a free state in FIG. 2. Button 72 biases arms 14 and 16 to swing out from wall 6 from their FIG. 3 position as carries 20 and 22 begin moving toward each other. Button 72 thus prevents the arms from locking up or folding toward wall 6 when hinge elements approach each other. Instead of using button 72, arms 14 and 16 may be left slightly oblique, or swung away from, wall 6 in the FIG. 3 position so that the arms swing outward when carriers 20 and 22 move together.

Figure 5:
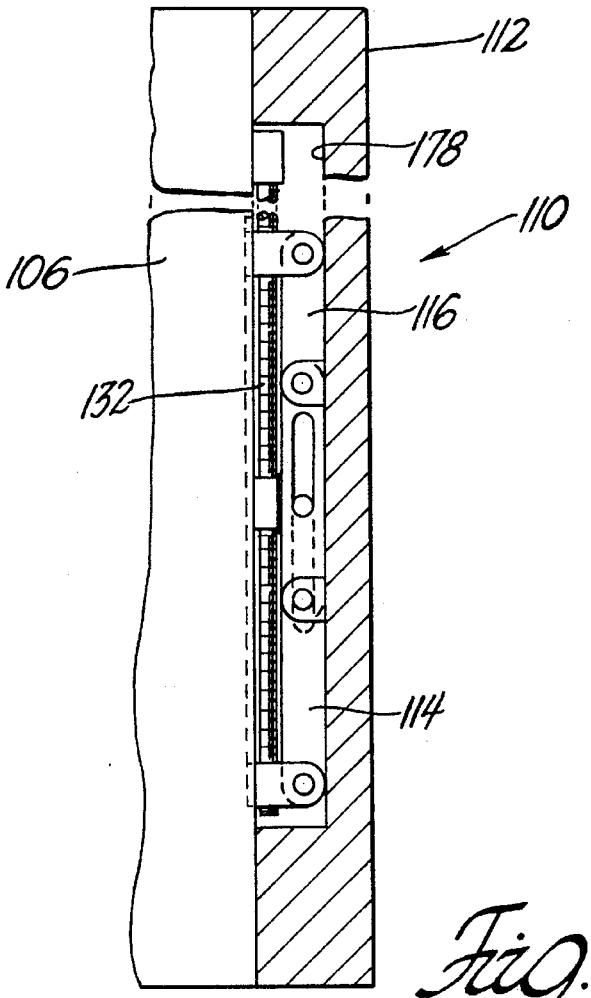
FIG. 5 is an elevational view of a further embodiment of the vehicle armor assembly in a retracted configuration.
Figure 6:
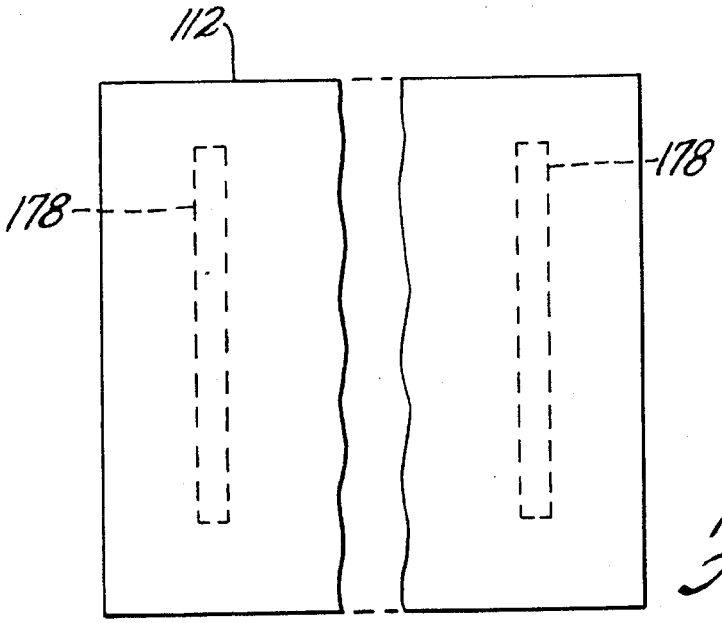
FIG. 6 shows an armor plate used with the FIG. 5 configuration of my assembly.

FIG. 5 shows an alternate embodiment 110 of the extendable armor assembly mounted on wall 106 wherein plate 112 defines a flat rectangular recess 178. Assembly 110 is otherwise similar to assembly 10 with certain exceptions. First, arms 114 and 116, analogous to arms 14 and 16 of FIG. 3, lie against plate 112, analogous to plate 12. Second, arms 114 and 116 also lie against rod 132, analogous to rod 32 in FIG. 3. Third rod 132 is adjacent wall 106. The advantage of assembly 110 over assembly 10 is that assembly 110 occupies less volume while achieving greater armor protection. FIG. 6 shows typical locations of recesses 178 on armor plate 112.

I do not desire to be limited to the exact details of construction or method shown herein since obvious modifications will occur to those skilled in the relevant arts without departing from the spirit and scope of the following claims.

What is claimed is:

1. An extendable armor assembly for ballistically protecting an exterior zone of a vehicle, comprising:

a track recessed in the exterior zone;

a first carrier closely fit to the track and translatable along the track;

a first through aperture in the first carrier;

a second carrier closely fit to the track and translatable along the track;

a second through aperture in the second carrier;

wherein the first aperture is threaded oppositely from, and has a different thread pitch than, the second aperture;

a rod disposed along and parallel to the track, the rod having a first portion threaded with the first aperture and a second portion threaded with the second aperture, whereby rotation of the rod translates the carriers in opposite axial directions at different speeds relative to the rod;

means for rotating the rod;

a first arm;

an inboard end of the first arm pivotally connected to the first carrier;

a second arm longer than the first arm;

an inboard end of the second arm pivotally connected to the second carrier;

the first arm defining a first elongate slot;

the second arm defining a second elongate slot, the second slot being longer than the first slot;

a pin connecting the arms at an intersection of the arms, the pin closely but slidably fitting the elongate slots, the arms being simultaneously translatable and rotatable relative to the pin;

an armor element;

an outboard end of the first arm;

a first hinge element fixed to the armor element and pivotally connected to the outboard end of the first arm;

an outboard end of the second arm;

a second hinge element fixed to the armor element and pivotally connected to the outboard end of the second arm;

wherein the armor element is movable between a retracted position parallel to the exterior zone and a deployed position oblique to the exterior zone, the deployed position being further from the exterior zone than the retracted position;

means for preventing the arms from locking up in the retracted position.

2. The assembly of claim 1 wherein:

the armor element defines a recess;

the rod, the arms, the hinge elements, and the means for rotating the rod fit within the recess during the retracted position.

3. The assembly of claim 1 further including:

a bracket fixed on the exterior zone between the carriers;

an unthreaded portion of the rod passing through the bracket;

wherein the preventing means includes an elastomeric button on the bracket faced away from the exterior zone.

4. An armor assembly at an exterior zone of a vehicle, comprising:

a track at the exterior zone;

a first carrier translatable along the track;

a second carrier translatable along the track;

means for effecting relative axial motion of the carriers along the track;

a first arm pivotally connected to the first carrier;

a second arm pivotally connected to the second carrier;

the first arm defining a first elongate slot;

the second arm defining a second elongate slot;

a pin connecting the arms and engaging the elongate slots, the arms being translatable and rotatable relative to the pin;

an armor element;

a first hinge element attached to the armor element and pivotally connected to the first arm;

a second hinge element attached to the armor element and pivotally connected to the second arm;

wherein the armor element has a retracted position parallel to the exterior zone and a deployed position oblique to the exterior zone, the deployed position being further from the exterior zone than the retracted position.

5. The assembly of claim 4 wherein the means for effecting relative axial motion of the carriers comprises:

a first through aperture in the first carrier;

a second through aperture in the second carrier;

wherein the first aperture has a different thread pitch than the second aperture;

a rod disposed along and parallel to the track, the rod having a first portion threaded with the first aperture and a second portion threaded with the second aperture;

means for rotating the rod.

6. The assembly of claim 4 further comprising:

an inboard end of the first arm pivotally connected to the first carrier;

an inboard end of the second arm pivotally connected to the second carrier;

wherein the first arm is shorter than the second arm, the first elongate slot is shorter than the second elongate slot, and the hinge elements are fixed relative to one another.

7. The assembly of claim 6 wherein:

the pin connects the arms at an intersection of the arms: and the pin closely but slidably fits with the elongate slots.

* * * * *